US009932783B2

(12) United States Patent
Magnuson

(10) Patent No.: US 9,932,783 B2
(45) Date of Patent: Apr. 3, 2018

(54) LATERALLY MOVING RACKER DEVICE ON A DRILLING RIG

(71) Applicant: Nabors Industries, Inc., Houston, TX (US)

(72) Inventor: Christopher Magnuson, Houston, TX (US)

(73) Assignee: Nabors Industries, Inc., Houston, TX (US)

( * ) Notice: Subject to any disclaimer, the term of this patent is extended or adjusted under 35 U.S.C. 154(b) by 234 days.

(21) Appl. No.: 14/469,984

(22) Filed: Aug. 27, 2014

(65) Prior Publication Data

US 2016/0060979 A1 Mar. 3, 2016

(51) Int. Cl.
*E21B 19/00* (2006.01)
*E21B 19/14* (2006.01)

(52) U.S. Cl.
CPC ..... *E21B 19/14* (2013.01)

(58) Field of Classification Search
CPC ..... E21B 19/14; E21B 15/00; E21B 19/20
USPC ..... 414/22.51–22.71
See application file for complete search history.

(56) References Cited

U.S. PATENT DOCUMENTS 2,412,020 A * 12/1946 Walters ..... E21B 19/14 182/114
3,592,347 A * 7/1971 Kelly ..... E21B 19/14 114/264
3,978,993 A 9/1976 Howard
4,109,800 A 8/1978 Howard et al.
4,610,315 A * 9/1986 Koga ..... E21B 19/20 175/203
4,621,974 A * 11/1986 Krueger ..... E21B 19/20 211/70.4
5,107,940 A * 4/1992 Berry ..... E21B 7/023 175/122
5,244,329 A 9/1993 McGill et al.
5,423,390 A 6/1995 Donnally et al.
5,437,527 A 8/1995 McGill et al.
5,451,129 A * 9/1995 Boyadjieff ..... B65G 1/0442 414/22.61
6,343,662 B2 2/2002 Byrt et al.
6,926,488 B1 8/2005 Bolding et al.
7,246,983 B2 7/2007 Zahn et al.
7,699,122 B2 * 4/2010 Eriksen ..... E21B 19/14 175/52

(Continued)

FOREIGN PATENT DOCUMENTS

WO WO 2013/116440 * 8/2013 ..... A61F 2/82

*Primary Examiner* — Anna M Momper
*Assistant Examiner* — Lynn E Schwenning
(74) *Attorney, Agent, or Firm* — Haynes and Boone, LLP

(57) ABSTRACT

Apparatus and methods include a well-center drilling opening in a drilling rig floor of a mobile drilling rig and a v-door to the drilling rig. A mast is disposed about the well-center drilling opening and carrying drilling components of a drilling system. The mast supports a fingerboard that includes a plurality of parallel longitudinally extending fingers having openings between ends thereof and being arranged to receive tubulars therebetween. The plurality of fingers extending in the same direction as a line between the well-center drilling opening and the v-door. A racker device is moveable in a lateral direction relative to the direction of the line between the well-center drilling opening and the v-door.

19 Claims, 7 Drawing Sheets

(56) References Cited

U.S. PATENT DOCUMENTS

| | | | | |
|---|---|---|---|---|
| 7,794,192 | B2 * | 9/2010 | Wright | E21B 19/20 414/22.65 |
| 7,802,636 | B2 * | 9/2010 | Childers | E21B 19/20 166/380 |
| 7,967,541 | B2 | 6/2011 | Stroshein et al. | |
| 2008/0164064 | A1 | 7/2008 | Belik et al. | |
| 2009/0053015 | A1 * | 2/2009 | Zachariasen | E21B 19/14 414/22.66 |
| 2009/0159294 | A1 * | 6/2009 | Abdollahi | E21B 19/14 166/377 |
| 2012/0020758 | A1 * | 1/2012 | Springett | E21B 19/14 414/22.63 |
| 2012/0212326 | A1 | 8/2012 | Christiansen et al. | |
| 2012/0217024 | A1 | 8/2012 | Childers et al. | |

* cited by examiner

LATERALLY MOVING RACKER DEVICE ON A DRILLING RIG

TECHNICAL FIELD

The present disclosure is directed to systems, devices, and methods for the manipulation, assembly and moving of tubulars in or out of a derrick or mast in oil and gas drilling systems. More specifically, the present disclosure is directed systems, devices, and methods including a pipe racking system structurally arranged to move laterally across a portion of the drilling rig to manipulate tubulars for stand or drill string assembly, disassembly, racking, or other tasks useful in the drilling industries.

BACKGROUND OF THE DISCLOSURE

The exploration and production of hydrocarbons require the use of numerous types of tubulars, also referred to as pipe. Tubulars include but are not limited to drill pipes, casings, and other threadably connectable elements used in well structures. Strings of joined tubulars, or drill strings, are often used to drill a wellbore and, with regards to casing, prevent collapse of the wellbore after drilling. These tubulars are normally assembled in groups of two or more commonly known as "stands" to be vertically stored in the derrick or mast. The derrick or mast may include a storing structure commonly referred to as a fingerboard. Fingerboards typically include a plurality of vertically elongated support structures or "fingers" each capable of receiving a plurality of "stands."

Rotary Drilling and Top Drive drilling systems often use these stands, instead of single tubulars, to increase efficiency of drilling operations by reducing the amount of connections required to build the drill string in or directly over the wellbore. The manipulation of tubulars from a horizontal to a vertical position, assembly of stands and presentation of stands between the fingerboard and wellcenter, however, are dangerous and can be rather inefficient operations.

Conventional rigs are arranged to provide a racker device that moves between fingerboards along an access path extending between a rig v-door and well-center. When properly positioned, the racker may reach laterally to engage or grasp a stand within the fingerboard. Carrying the stand, the racker may then travel from a position between the fingerboards toward well-center to present the stand to well-center.

The present disclosure is directed to systems and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 6-1 is a schematic of an exemplary apparatus according to one or more aspects of the present disclosure showing a racker carriage track with racker movement capability.

FIG. 6-2 is a schematic of an exemplary apparatus according to one or more aspects of the present disclosure showing a racker carriage track with racker movement capability.

FIG. 6-3 is a schematic of an exemplary apparatus according to one or more aspects of the present disclosure showing a racker carriage track with racker movement capability.

DETAILED DESCRIPTION

Figure 1:
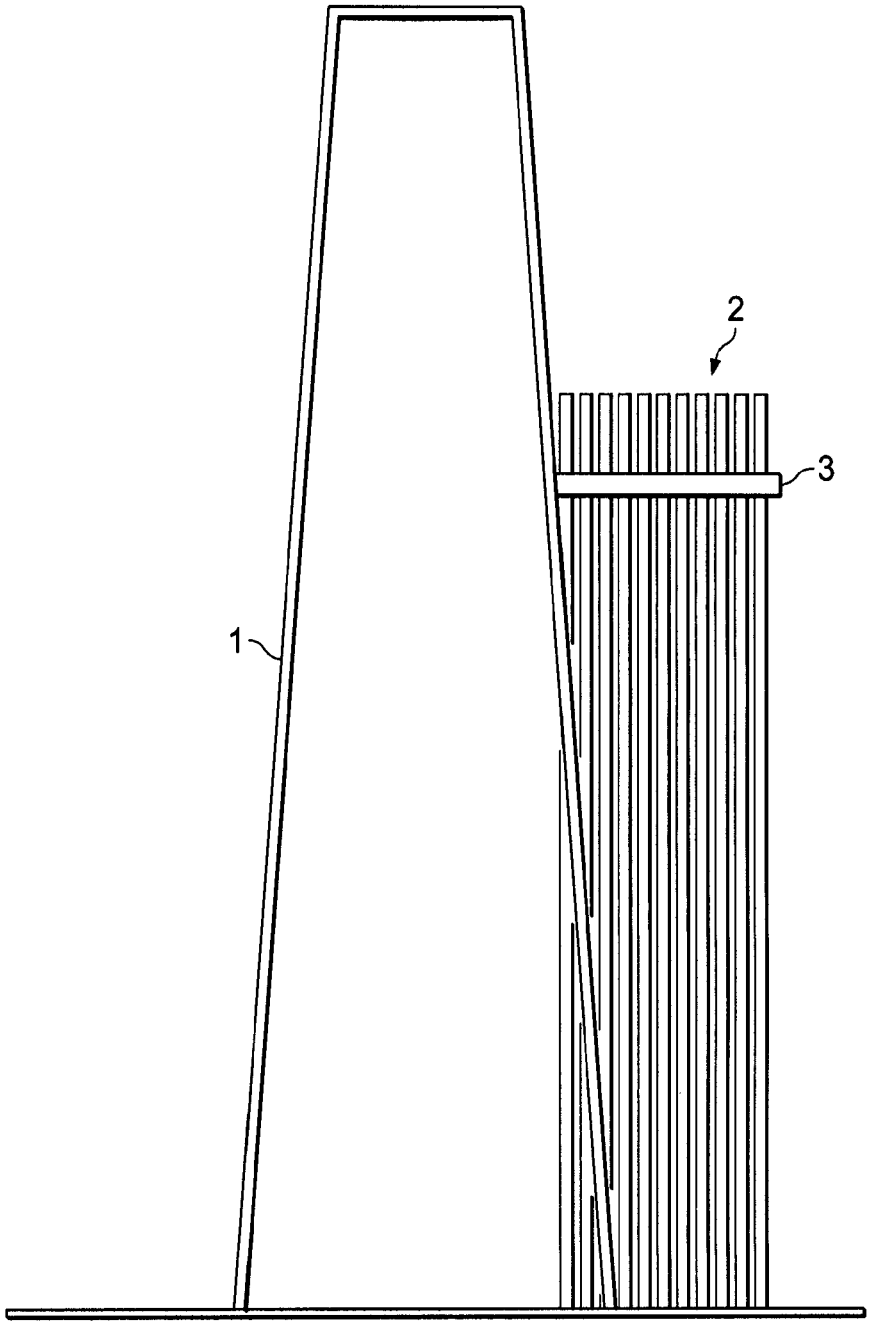
Fig. 1 (PRIOR ART)
FIG. 1 is a schematic of an exemplary conventional apparatus.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The systems, devices, and methods described herein may be used to manipulate pipe between a fingerboard and well-center of a drilling rig in a more efficient manner by having an arrangement that permits a racker device to move along, or at least primarily along, a pathway extending in a lateral direction from a line between the fingerboard and well-center, rather than along a pathway between a rig v-door and well-center. In one preferred embodiment, the line is from a central point of two halves or two portions of a fingerboard to well-center. Doing this, the systems, devices, and methods may be used to transfer pipe including tubulars such as drilling pipe, tubing, and casing between a storage area in the fingerboard to well-center for simple manipulation with less movement than, and consequently, can take less time than and can minimize risk to personnel compared to, conventional systems. In some embodiments, a complete stand may be built without rig personnel being required on the drill floor. That is, the pipe manipulation may be completely automated and may be performed under the control of a controller that sends signals or monitors each aspect of the systems, devices, and methods disclosed herein and takes corrective action including stopping all movement if needed.

In addition, the systems, devices, and methods disclosed herein include the laterally moving racker along with a mast that supports and carries a fingerboard arranged with openings facing toward well-center, or at least in a direction generally inward towards the middle of the drilling rig platform, rather than facing towards a line from well-center to an edge of the drilling rig as in conventional racking systems. The laterally moving racker device moves along the front of the fingerboard between the opening to the fingerboard and well-center. Since the mast supports the laterally arranged fingerboard, the drilling rig floor-space can be maintained in an orderly, less congested condition. This permits the placement of other structures and rig equipment about the drilling rig, can expedite rig operations, and can increase safety for rig personnel.

The systems, devices, and methods disclosed herein, unlike other stand racking systems, include a column racking device that moves in the lateral or y-direction, expands its upper and lower manipulator arms, and rotates about an axis in an angular manner. This type of movement permits the stand to be presented to well-center in a manner not previously obtainable. The advantages obtained by the drilling rig may be due to the arrangement of the fingerboard. For example, instead of facing the pathway between the v-door and well-center, the fingerboard arrangement disclosed herein faces the direction of well-center, such that the well-center is disposed in the front of the fingerboard instead of at the side of the fingerboard. Because of this, the laterally extending travel pathway of the racker device is along a pathway that laterally extends tangent to well-center, at a location offset from well-center.

This systems, devices, and methods possess numerous other advantages, and have other purposes which may be made more clearly apparent from consideration of the attached embodiments. These embodiments are shown in the drawings accompanying this description. The embodiments will now be described in detail, for the purpose of illustrating the general principals of the systems, devices, and methods, but it is to be understood that one skilled in the art is not to be taken in a limiting sense, since the scope of the invention is best defined by the appended claims.

As used herein, the terms "longitudinal" and "longitudinally" represent the direction extending between well-center and the v-door on the drilling rig. The terms "lateral" and "laterally" represent a direction extending perpendicular or oblique to the longitudinal direction.

Figure 2:
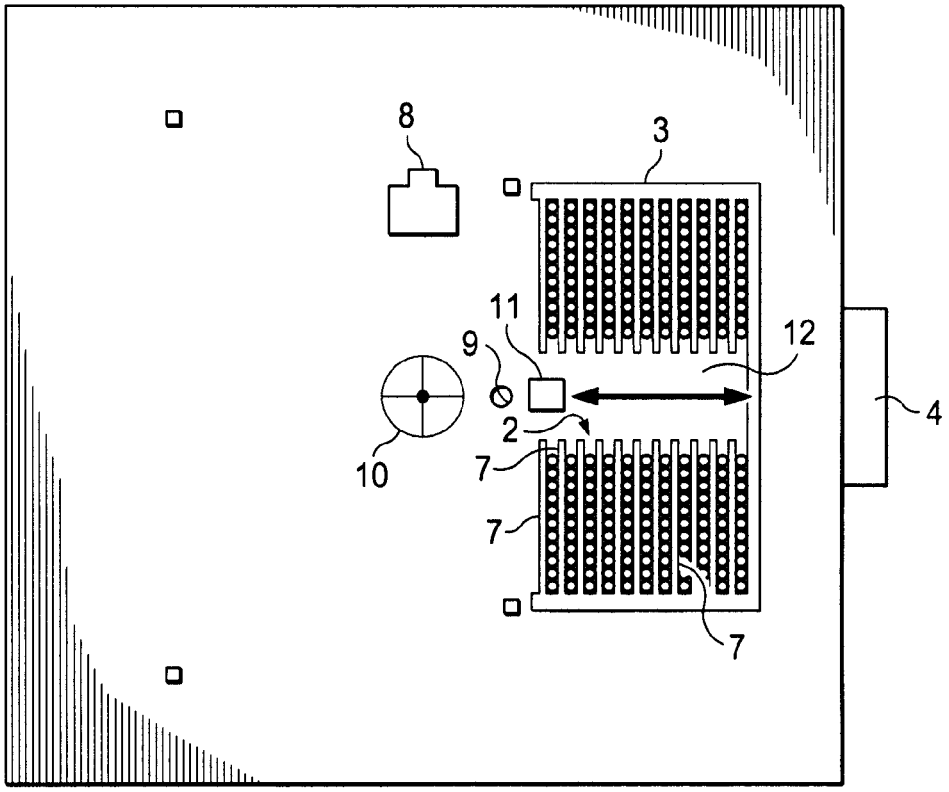
Fig. 2 (PRIOR ART)
FIG. 2 is a schematic of a top view of the conventional apparatus of FIG. 1.

FIG. 1 and FIG. 2 show a conventional system from a side view and a top view respectively in order to compare some of the unique features of the systems, devices, and methods disclosed herein. The conventional system shown may form a part of a mobile drilling rig. Because of their mobile natures, mobile drilling rigs typically have small drill floors of about 35×35 ft. Because of their compact size, mobile drilling rigs are conventionally configured to build stands on-line, or inline with well-center. Referring first to the side profile shown in FIG. 1, the conventional system includes a traditional mast 1, traditional drillpipe (in stands) 2, a traditional fingerboard 3, and a traditional v-door 4. The v-door 4 is used when introducing tubulars or stands to the rig or when removing them from the rig.

FIG. 2 shows a top view of the conventional drilling rig displaying the relative layout of some of the drilling components of the rig. It includes the fingerboard 3, the stands 2, fingers 7 forming a part of the fingerboard 3, an iron roughneck 8, a mousehole 9, a well-center 10, and a racker device 11. A passageway 12 extends between opposing ides of the fingerboard between the v-door 4 and well-center 10. The racker device 11 travels along the passageway 12 indicated by the arrow to manipulate tubulars or stands between the fingerboard 3, the mousehole 9, well-center 10, and the v-door 4.

Figure 3:
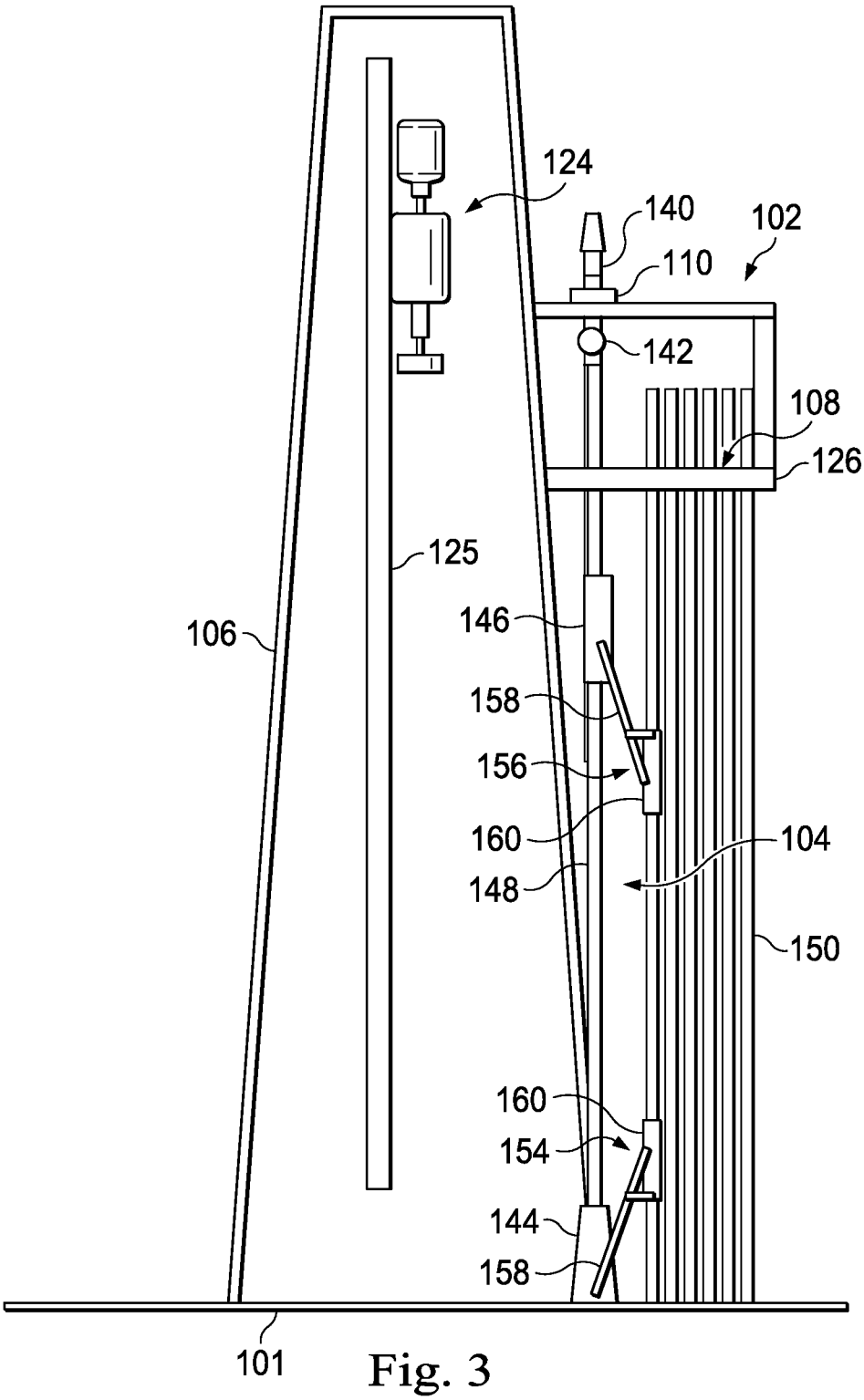
FIG. 3 is a schematic of an exemplary apparatus according to one or more aspects of the present disclosure.
Figure 4:
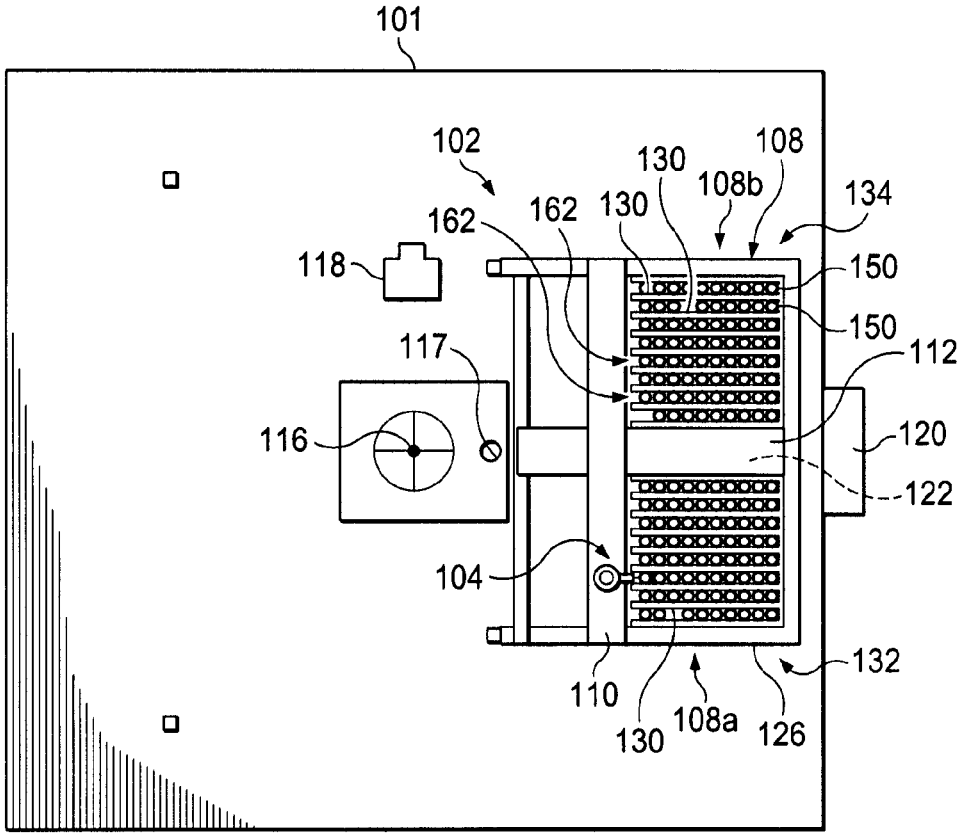
FIG. 4 is a schematic of a top view of the apparatus of FIG. 3 according to one or more aspects of the present disclosure.

FIGS. 3 and 4 show the improved system 100 of the present disclosure, with FIG. 3 showing a side profile and FIG. 4 showing a vertical profile of the system. The system 100 may form a part of a mobile drilling rig having a drillfloor size of about 35×35 ft, although larger and smaller rigs are contemplated. In some embodiments, the rig is smaller than about 1600 square feet. In other embodiments, the rig is smaller than about 1200 square feet. The system 100 disclosed herein is particularly useful because it permits a racker device to be used on rigs that are limited in size. As will be explained below, the system 100 is arranged to introduce or remove tubular stands into or from the fingerboard and, present them to well-center using a racker device that travels in a lateral or transverse direction relative to a path between well-center and a v-door, and that rotates about an axis transverse to the lateral travel, while being maintained on a standard sized mobile drilling rig. In addition, because the fingerboard is preferably supported by and extends from the mast, fingerboard supporting structure on the rig floor may be reduced or altogether removed.

The system 100 shown in FIGS. 3 and 4 includes a rig 101 with rig based structures and support 102 and a racker device 104 that operates on the rig based structures and support 102. The rig based structures and support 102 include, for example, a mast 106, a fingerboard 108, a racker carriage track structure 110 extending in a lateral direction, a diving board 112 extending in a longitudinal direction, well-center drilling opening 116 in the rig floor, a mousehole 117, a well-center roughneck 118, and a v-door 120 into the drilling rig 101. The v-door 120 is arranged to receive tubulars or stands introduced to the rig 101. The fingerboard 108 includes a fingerboard frame 126 that supports and carries fingers 130 that define openings therebetween for receiving tubular stands. As shown in FIG. 4, the fingerboard 108 includes a left side 132 and a right side 134 separated by the diving board 112. A passageway 122 (located below the diving board 112 in FIG. 4 and shown in FIG. 5) extends between the right and left sides 132, 134 of the fingerboard 108 between the v-door 120 and well-center 116. The passageway 122 is a longitudinally extending region on the rig that allows stands or tubulars to be introduced onto or removed from the rig 101. Depending on the fingerboard arrangement, this longitudinally extending region may extend between the right and left sides 132, 134 of the fingerboard 108. As used herein, the left side is the portion of the fingerboard on the left side of the passageway 122 when viewing from the v-door 120 on the rig 101 toward the well-center 116. In a similar manner, the right side is the portion of the fingerboard 108 on the right side of the passageway when looking from the v-door 120 toward the well-center 116. In this embodiment, the mast 106 is disposed over and about well-center 116 and supports a plurality of drilling components of a drilling system, shown here as a top drive 124 and its components disposed and moveable along a support column 125. Other drilling components are also contemplated.

As best shown in FIG. 3, the racker device 104 includes a racker upper drive carriage 140, a modular racker hoist 142, a lower drive carriage 144, an upper column drive 146, and a racker support column 148. Drill pipe stands 150 are shown in FIGS. 3 and 4 and may be transferred by the racker device 104 on the rig based structures and supports 102 into and out of the fingerboard 108, and transferred into or out of the well-center 116.

The racker support column 148 may be formed of a single beam or multiple beams joined together. In some embodiments, the racker support column 148 is a structural support along which the column drive 146 may move upward or downward on rollers, slide pads, or other elements.

In some exemplary embodiments, the upper drive carriage 140 is configured to move the upper portion of the racker support column 148 along the racker carriage track structure 110. The upper drive carriage 140 may include rollers, sliding pads, or other structure that facilitates it moving, along with the racker device of which it is a part, laterally across the front of the fingerboard 108. In some embodiments, the upper drive carriage 140 is a part of a chain structure that drives the racker device in the lateral direction in front of the fingerboard 108. In addition, it may cooperate with or may include the racker hoist 142 and may be configured to operate the racker hoist 142 to raise and lower the upper column drive 146 along the racker support column 148. That is, the racker hoist 142 may be in operable engagement with the upper drive carriage 140 and may be driven by the upper drive carriage 140. It moves the upper column drive 146 up or down in the vertical direction along the racker support column 148.

The lower drive carriage 144 and the upper column drive 146 cooperate to manipulate tubulars and/or stands. In this embodiment, the lower drive carriage 144 includes a drive system that allows the lower drive carriage 144 to displace along the rig floor. In some embodiments, this occurs along rails or tracks as discussed below. The upper column drive 146 and the lower drive carriage 144 respectively include a lower tubular interfacing element 154 and an upper tubular interfacing element 156. Each includes a manipulator arm 158 and a gripper head 160. The gripper heads 160 may be sized and shaped to open and close to grasp or retain tubing, such as tubulars or stands. The manipulator arms 158 may move the gripper heads 160 toward and away from the racker support column 148. These upper and lower tubular interfacing elements 156, 154 are configured to reach out to insert a drill pipe stand into or remove a drill pipe stand from fingerboard 108. That is, the upper and lower tubular interfacing elements 156, 154 extend outwardly from the racker support column 148 to clamp onto or otherwise secure a drill pipe stand that is in the fingerboard 108 or to place a drill pipe stand in the fingerboard. As indicated above, the column drive 146 may move vertically up and down along the racker support column 148. In some aspects, it is operated by the hoist 142.

The fingerboard 108 is a rack formed of a plurality of fingers 130 spaced to receive pipe stands and maintain the pipe stands in a substantially vertical orientation. Adjacent fingers 130 form openings 162 sized to receive the tubulars or stands. The fingers 130 extend in parallel, and in the embodiment shown, extend in generally the same direction as the passageway 122 so that the openings 162 between fingers 130 of the fingerboard face the travel path of the laterally moving racker device 104 that is offset from well-center 116. In this embodiment, the fingers 130 all extend in parallel lines in a direction substantially parallel to the pathway 122 or a line extending between well-center 116 and a v-door 120. However, in other embodiments, the fingers are disposed at an oblique angle relative to a line extending between well-center 116 and the v-door 120, but the openings 162 remain facing the travel path of the laterally moving racker device 104. The fingerboard 108 includes a left side fingerboard portion 108*a* and a right side fingerboard portion 108*b* on opposing sides of the passageway 122 between the v-door and well-center. The spacing between the two portions 108*a*, 108*b* of the fingerboard 108 forms the passageway 122 extending between the v-door 120 and well-center 116.

In the embodiments, shown, the fingerboard 108 is attached to and carried by the mast 106. The fingerboard frame 126 may be connected to or carried by mast 106 so that the fingerboard 108 is cantilevered over the drilling rig floor from the mast, while still permitting the laterally moving racker device 104 to travel along the front of the fingerboard 108 to access or introduce tubulars and stands into the fingerboard. In some embodiments, as can be seen in the side view of FIG. 3, the fingerboard frame 126 may be supported with additional structure supporting the fingerboard 108 on the mast 106. The fingerboard frame 126 supports the fingers 130 and provides rigidity to the fingerboard 108.

In the embodiment shown, the racker carriage track structure 110 is formed of one or more structural beams extending in a direction lateral to the passageway 112. In the exemplary embodiment shown in FIG. 3, the racker carriage track structure 110 is disposed above the fingerboard 108. In some embodiments, the racker carriage track structure 110 is disposed above stands within the fingerboard 108. For example, they may be disposed above a triple stand, formed of three tubulars. In other embodiments, the racker carriage track structure 110 is disposed so as to be above quad stands, formed of four tubulars. The racker carriage track structure 110, like the fingerboard 108, may be carried on or coupled to a cantilevered structure extending from the mast 106. In the embodiment shown, the cantilevered structure supports both the fingerboard 108 and the racker carriage track structure 110. Other arrangements are also contemplated.

In some embodiments, the racker carriage track structure 110 includes two parallel support structures that extend so as to not intersect the well-center 16 and in front of the openings 162 formed by fingers 130 of the fingerboard 108. In some embodiments, the racker carriage track structure 110 is fixed in place relative to the mast 106 and other supporting structure. As will be explained below, the racker device 104 may move along the racker carriage track structure 110, thereby providing mobility to the racker device 104 in the lateral direction, transverse to a line or the passage 122 between well-center 116 and the v-door 120. It is worth noting that during standard operation, the racker column support 148 of the racker device 104 may move laterally along the pathway extending so as to bypass the well-center 116 and pass in front of the openings 162 on both the left and right sides 108*a*, 108*b* of the fingerboard 108. In the exemplary embodiment shown, the upper and lower tubular interfacing elements 156, 154 are configured to extend outwardly from the racker support column 148 when placing a stand in or removing a stand from the fingerboard 108.

Figure 5:
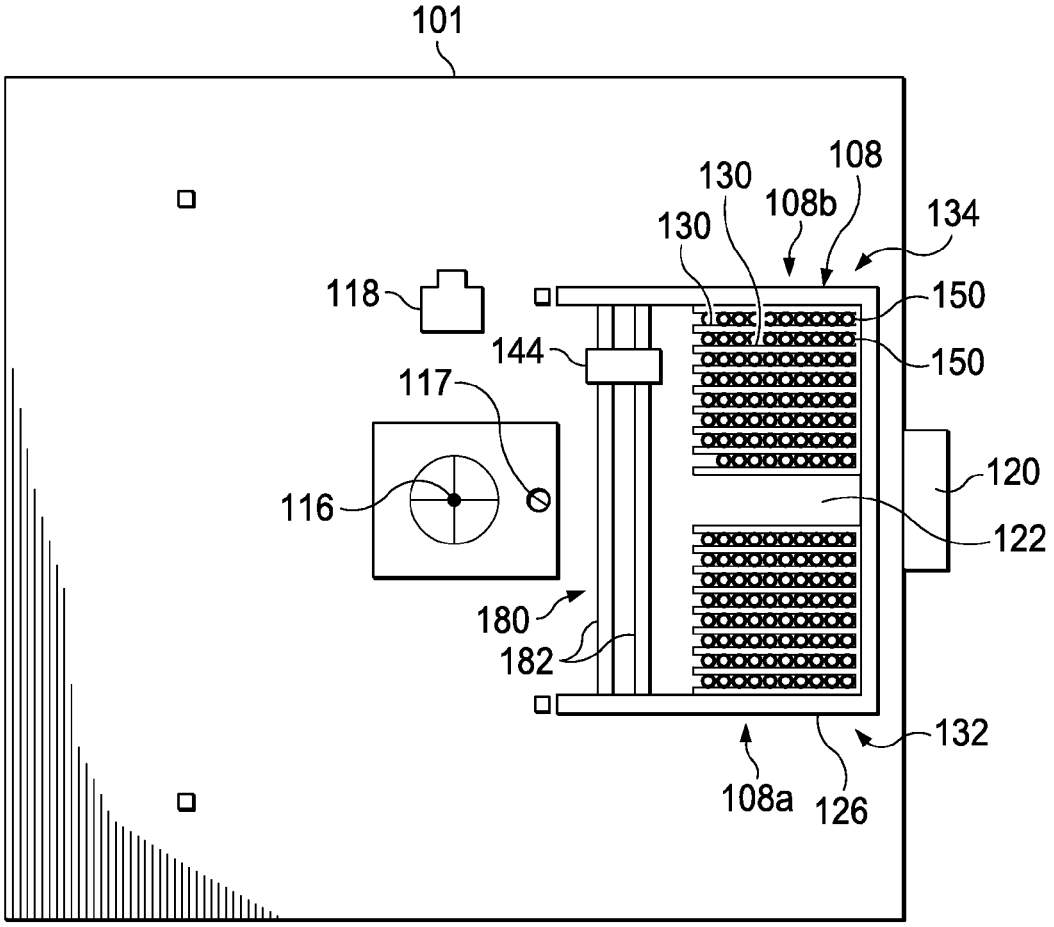
FIG. 5 is a schematic of an exemplary apparatus according to one or more aspects of the present disclosure showing a floor track.

Although not shown in FIG. 4 for clarity, FIG. 5 shows additional supporting structure that may disposed on or about the rig floor that may be used to convey the lower end of the racker device 104 in the lateral direction. In this embodiment, the additional supporting structure includes a track 180 formed of parallel rails 182 on the rig floor and along which the lower drive carriage 144 of the racker device may move.

The track 180 may guide the lower drive carriage 144 as the racker device moves in the lateral direction across the drilling rig. In some embodiments, the lower drive carriage 144 includes or is driven by a power element that moves it along the track 180. The power element may be a motor, such as a hydraulic motor that advances the lower drive carriage 144 along the track 180. Other embodiments have a different motor as a power element, an engine, a driver, or other actuator. In this embodiment, where the track 180 is formed of rails 182, the lower drive carriage 144 may include wheels or rollers that roll along the rails. Other embodiments use a track formed of a chain, a friction guide or other structure that constrains movement of the lower drive carriage 144 to desired directions. In the embodiment shown in FIG. 5, the track 180 extends in a direction tangent to the remainder of the system 100 on a mobile drilling rig and extends in front of both the left side 108*a* and the right side 108*b* of the fingerboard 108, while passing between the fingerboard 108 and well-center 116. Accordingly, the racker device is configured to pass across the end of the passageway 122 that extends between well-center 116 and the v-door 120.

Figures 1, 6:
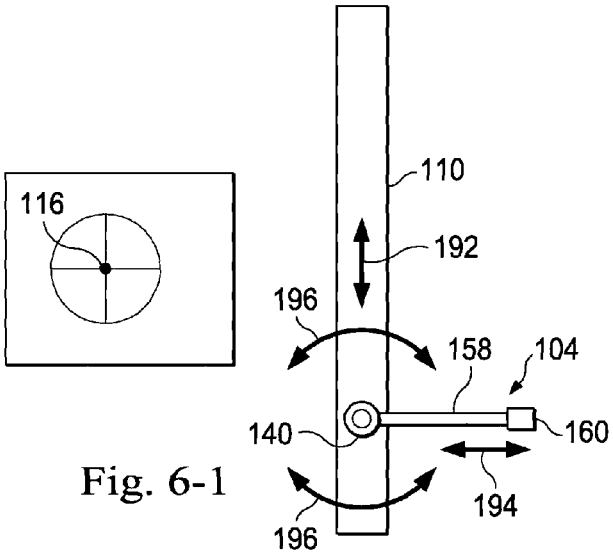
Figures 2, 6:
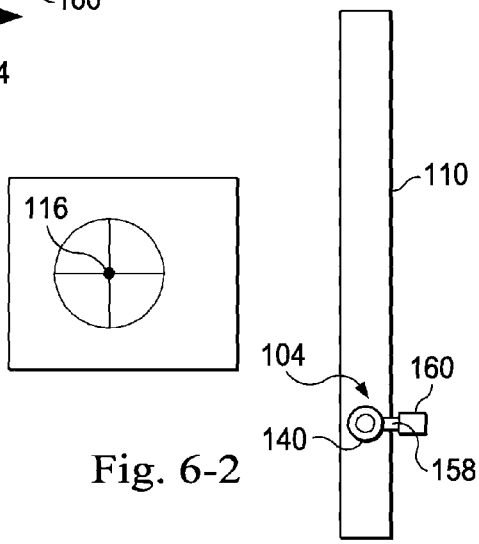
Figures 3, 6:
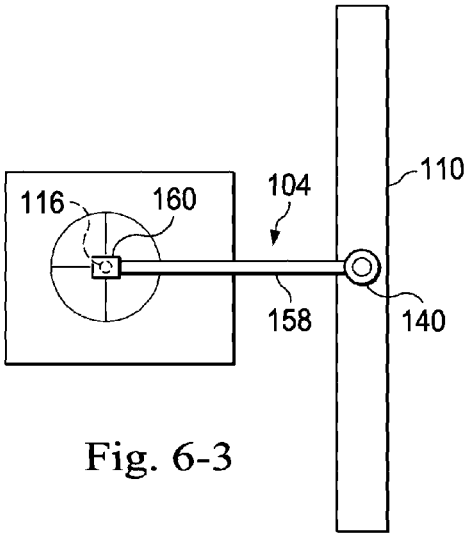

FIGS. 6-1 to 6-3 show some of the movement obtained when operating the system of the present disclosure to perform pipe stand building, racking, and moving pipe stands to the well-center 116. These Figures show a top profile of a portion of the system 100 with the racker device 104 disposed to manipulate tubulars or stands to perform pipe stand building, racking, and moving pipe stands to the well-center 116. FIG. 6-1 shows the racker upper drive carriage 140, racker carriage track structure 110, manipulator arm 158 and gripper head 160. Arrows 192, 194, 196 show the reversible movement capabilities of the racker device 104 relative to well-center 116 and the racker carriage track structure 110. Arrow 192 shows that the racker device 104 may move in the lateral direction along the racker carriage track structure 110. Arrow 194 shows that racker device 104 may extend its reach, such as into the fingerboard 108 (FIG. 4) using the manipulator arm 158 and gripper head 160. Arrows 196 show that the racker device may rotate about itself, thereby swinging the manipulator arm 158 and gripper head 160 from one side to the other to pick up or drop off tubulars or stands, depending on whether a tubular string is being made-up or broken-out. It should be understood that all operations and embodiments described in the present disclosure are reversible as needed so that a tubular string can be made-up or broken-out. Most operations described herein are with respect to the make-up operation of the system and apparatus for the sake of simplicity. FIG. 6-2 shows the racker device 104 with the manipulator arm 158 and gripper head 160 retracted. FIG. 6-3 shows the racker device 104 having laterally moved along the racker carriage track structure 110, rotated to face well-center 116, and with the manipulator arm 158 and gripper head 160 extended to reach to well-center 116. While shown to access the fingerboard 108 and the well-center 116, it should be recognized that the racker device 104 may also be used to access the mousehole 117 (FIG. 4) or other mousehole to build stands or perform other operational processes. In some embodiments, the position shown in FIG. 6-2 may be a stow position where the racker device 140 may be parked while activity occurs at well-center 116, in the passageway 122, or at other locations about the rig.

Figure 7:
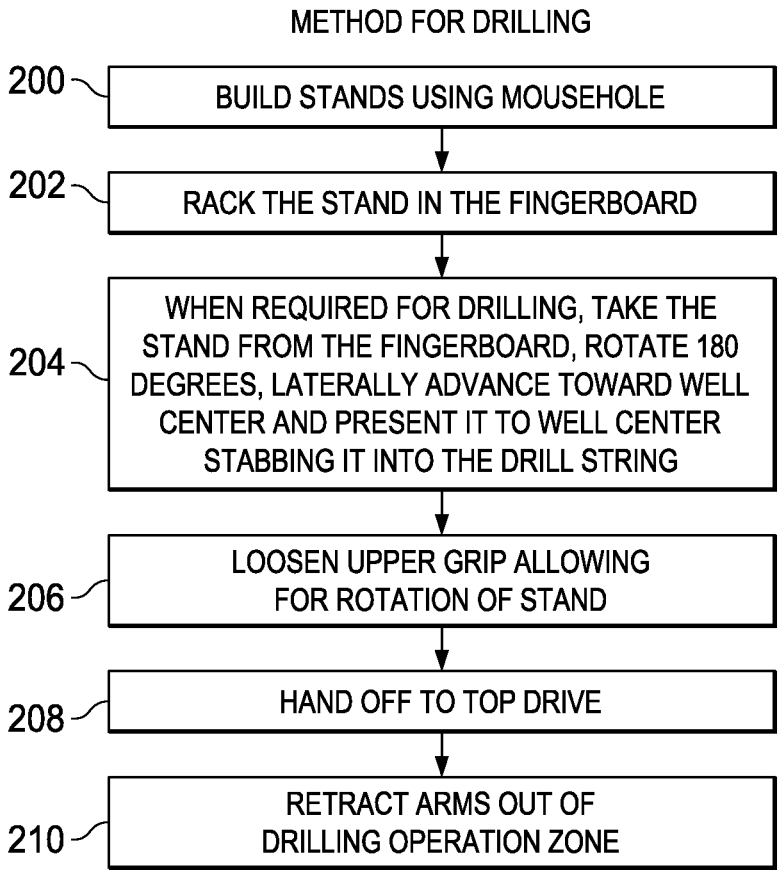
FIG. 7 is a flow chart showing a method according to one or more aspects of the present disclosure.

FIG. 7 is a flow chart showing steps of a method for drilling a well using the system and methods of the present disclosure. The method may be performed using a controller to control the system 100 and to control the movements of the racker upper drive carriage 140, the modular racker hoist 142, the lower drive carriage 144, the upper column drive 146, and other elements of the system, including the top drive 124 (FIG. 3). The method in FIG. 7 begins at 200 with building a stand using the mousehole 117. The system 100 described herein receives tubulars through the v-door 120. The stands of tubulars are assembled, as depicted, using the mousehole 119 in a standard manner by screwing a plurality of stands together. In some aspects, however, the stand is built or disassembled offline, typically in advance of a drilling or casing operation. This may increase efficiency of operation of the drilling rig because the stand building or disassembly does not inhibit or prevent access to the well-center 116.

When the stand is complete, the stand may be racked in the fingerboard 108 at 202. This may include grasping the built stand with the upper tubular interfacing element 156 and hoisting the stand using the hoist 142. That is, the hoist 142 may raise the column drive 146 along the racker support column 148, and with it, the stand. The stand may then be grasped or otherwise secured by both the column drive 146 and the lower drive carriage 144 and vertically lifted and moved and racked in the fingerboard 108. This may further include laterally moving the racker support column 148 in the lateral direction along the laterally extending racker carriage track structure 110 to a position in front of the desired opening 162 to the fingerboard 108. This may also include rotating the racker support column 148 about an axis to face a desired direction.

To rack the stand, the upper and lower tubular interfacing elements 156, 154 extend as needed to insert the stand into the fingerboard 108. To do this, the lower and upper tubular interfacing elements 156, 154 rotate about the axis of the racker support column 148 to align the stand with the desired slot between fingers 130 of the fingerboard 108. This may include rotating the support column 148 or may include rotating the drive carriages 144, 146. In some examples, the lower and upper tubular interfacing elements 156, 154 rotate more than 90°, and in some embodiments, more than 150° about an axis associated with the racker support column 148. In some embodiments, the lower and upper tubular interfacing elements 156, 154 rotate 180° about an axis associated with the racker support column 148. As such, the stand also rotates. When the stand is aligned as desired, the lower and upper tubular interfacing elements 156, 154 extend outwardly to pass the stand between fingers of the fingerboard 108 into the fingerboard. When properly located, the lower and upper tubular interfacing elements 156, 154 release the stand in the fingerboard 108, and retract toward the racker support column 148. The lower and upper tubular interfacing elements 156, 154 may then rotate about the axis of the racker support column 148 to a neutral position.

At a step 204, when required for drilling, the racker device 104 may take the stand from the fingerboard and present the stand to well-center. To do this, the racker device may rotate 180° about an axis of the racker support column 148 so that the lower and upper tubular interfacing elements 156, 154 are facing the openings to the fingerboard 108. The racker device 104 may move laterally along the fingerboard via the racker carriage track structure 110 toward the well-center 116. In some embodiments, the system 100 may be configured to take stands from the fingerboard 108 that are closest to the well-center. This may provide efficiency in operation and may speed the drilling process. When the racker device is aligned as desired, the lower and upper tubular interfacing elements 156, 154 extend to grasp a stand in the fingerboard 108.

After the lower and upper tubular interfacing elements 156, 154 grasp a stand from the fingerboard, they may retract with the stand toward the racker support column 148. The racker device 104 may advance laterally along the racker carriage track structure 110 toward the well-center 116. In the embodiment shown, where the racker device 140 is disposed between the fingerboard 108 and well-center 116, the racker device, and the lower and upper tubular interfacing elements 156, 154, may rotate more than 150 degrees about the axis of the racker support column 148 to face the well-center 116. This may enable the racker device 140 to grasp the stand in the fingerboard on one side of the track 180, and rotate to present it to well center 116 on the other side of the track 180. This may require rotating up to 180 degrees. In some embodiments, where the longitudinally extending fingers are not parallel to a line between well-center 116 and the v-door, the racker device 140 may rotate about 150 degrees. Other ranges, larger and smaller, are contemplated.

When the racker device 104 is finished rotating, the lower and upper tubular interfacing elements 156, 154 may extend from the racker support column 148 until the stand is directly over the well-center 116. In some embodiments, the lower and upper tubular interfacing elements 156, 154 stab the stand into the drill string. In this position, the stand is also directly aligned with the top drive 250 in FIG. 3. The lower and upper tubular interfacing elements 156, 154 may then lower the stand into the well-center. With the stand in place, the upper tubular interfacing element 154 loosens the grip on the stand to allow the stand to rotate at a step 206.

An iron roughneck may make up a joint between the new stand and a previous stand. The stand may then be handed off to the top drive at a step 208. That is, with the stand in place, the top drive 250 may be lowered onto and may engage the end of the stand. The lower and upper tubular interfacing elements 156, 154 release the stand and retract toward the racker support column 148 out of the line of the top drive 124 (FIG. 3) at a step 210. The top drive 124 may then advance downward along the support 125 driving the stand into the well-center. As this occurs, the racker device 104 may simultaneously retract the lower and upper tubular interfacing elements 156, 154 and may move laterally along the racker carriage track structure 110 to the next stand to be retrieved. The top drive 124 may continue to drive the stand downward into the well-center, and afterward, may retract along the column 125 to its upward location so that it is ready for the next stand.

While shown with a gap between left and right sides of the fingerboard 108, some fingerboard embodiments do not have a gap or space. In such devices, the passageway or the longitudinally extending region may extend in the region below the fingerboard 108.

In view of all of the above and the figures, one of ordinary skill in the art will readily recognize that the present disclosure introduces an apparatus comprising: a well-center drilling opening in a drilling rig floor of a mobile drilling rig, a v-door to the drilling rig floor, and a longitudinally extending region between the well-center drilling opening and the v-door sized to receive and pass tubulars introduced to the drilling rig through the v-door. A mast may be disposed about the well-center drilling opening and supporting a plurality of drilling components of a drilling system, and a fingerboard is supported by and extending from the mast. The fingerboard has a plurality of longitudinally extending, parallel fingers having openings between ends thereof and being arranged to receive tubulars therebetween. The plurality of fingers extend in the same direction as the longitudinally extending region between the well-center drilling opening and the v-door.

In an aspect, the apparatus includes a racker device moveable in a lateral direction relative to the longitudinally extending region. The racker device is moveable between the well-center drilling opening and the openings of the fingerboard. In an aspect, the apparatus includes a track laterally extending between the well-center drilling opening and a number of the openings in the fingerboard, and the racker device is laterally moveable along the track. In an aspect, the racker device comprises tubular interfacing elements arranged to selectively extend and pick-up one or more stands of tubulars each disposed within one or more of the openings of the fingerboard. In an aspect, the fingerboard is positioned relative to the well-center drilling opening so that the racker device rotates 180 degrees after picking-up a stand within the fingerboard to present the stand to the well-center drilling opening. In an aspect, the fingerboard is cantilevered from the mast. In an aspect, the fingerboard comprises a left side and a right side, the right and left sides being separated by the longitudinally extending region. In an aspect, the plurality of parallel extending fingers extend in a direction parallel to a line between the well-center drilling opening and the v-door. In an aspect, the apparatus includes a racker carriage track structure disposed at an elevation above than the fingerboard, the racker carriage track structure extending in a lateral direction relative to the longitudinally extending region. In an aspect, the apparatus includes a floor track disposed on a rig floor, the floor track extending in a lateral direction relative to the longitudinally direction between the fingerboard and the well-center drilling opening. In an aspect, the plurality of drilling components comprises a top drive.

In another exemplary aspect, the present disclosure is directed to an apparatus that includes a well-center drilling opening in a drilling rig floor of a mobile drilling rig, a v-door to the drilling rig, and a mast disposed about the well-center drilling opening and supporting a plurality of drilling components of a drilling system. It also includes a cantilevered fingerboard supported by and extending from the mast. The fingerboard includes a plurality of parallel longitudinally extending fingers having openings between ends thereof and being arranged to receive tubulars therebetween. The plurality of fingers extend in the same direction as a line between the well-center drilling opening and the v-door. A racker device is moveable in a lateral direction relative to the direction of the line between the well-center drilling opening and the v-door.

In an aspect, the apparatus includes a track laterally extending between the well-center drilling opening and a number of the openings in the fingerboard, the racker device being laterally moveable along the track. In an aspect, the racker device comprises tubular interfacing elements arranged to selectively extend and pick-up one or more stands of tubulars disposed within the fingerboard. In an aspect, the fingerboard is positioned relative to the well-center drilling opening so that the racker device rotates 180 degrees after picking-up a stand within the fingerboard to present the stand to the well-center drilling opening.

In another exemplary aspect, the present disclosure is directed to a method that includes removing, with a racker device, a tubular stand from a fingerboard supported at least in part by a drilling rig mast and arranged with fingers that extend in a longitudinal direction and have openings therebetween ends thereof defining a front portion of the fingerboard. When the stand is clear of the fingerboard fingers, the method includes moving the racker device and the stand in a lateral direction along the front portion of the fingerboard, rotating the racker device and the stand at least 150 degrees so that the stand faces the well-center drilling opening of a drilling rig, and presenting the stand to the well-center drilling opening.

In an aspect, rotating the racker device and the stand at least 150 degrees includes rotating the racker device and the stand 180 degrees. In an aspect, the method includes grasping the stand with extendable arms of the racker device, and retracting the arms with the stand to remove the stand from the fingerboard. In an aspect, presenting the stand to the well-center drilling opening comprises extending arms of the racker device carrying the stand. In an aspect, moving racker device and the stand in a lateral direction along the front portion of the fingerboard comprises moving the racker device along a laterally extending track disposed between the well-center drilling opening and the front portion of the fingerboard.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. An apparatus comprising:

a well-center drilling opening in a drilling rig floor of a mobile drilling rig;

a v-door to the drilling rig floor at an edge of the drilling rig floor;

a longitudinally extending passageway between the well-center drilling opening and the v-door sized to receive and pass tubulars introduced to the drilling rig through the v-door;

a mast disposed about the well-center drilling opening and supporting a plurality of drilling components of a drilling system; and a fingerboard supported by and extending from the mast, the fingerboard having a first portion disposed adjacent a first side of the longitudinally extending passageway and a second portion disposed adjacent a second side of the longitudinally extending passageway, each of the first and the second portions having a plurality of longitudinally extending, parallel fingers having openings between ends thereof and being arranged to receive tubulars therebetween, the plurality of fingers extending in the same direction as the longitudinally extending passageway between the well-center drilling opening and the v-door; and a racker device moveable in a lateral direction relative to the longitudinally extending passageway, the racker device moveable in the lateral direction between the well-center drilling opening and the openings of the fingerboard.

2. The apparatus of claim 1, further comprising a track laterally extending between the well-center drilling opening and a number of the openings in the fingerboard, the racker device being laterally moveable along the track.

3. The apparatus of claim 1, wherein the racker device comprises tubular interfacing elements arranged to selectively extend and pick-up one or more stands of tubulars each disposed within one or more of the openings of the fingerboard.

4. The apparatus of claim 3, wherein the fingerboard is positioned relative to the well-center drilling opening so that the racker device rotates 180 degrees after picking-up a stand within the fingerboard to present the stand to the well-center drilling opening.

5. The apparatus of claim 1, wherein the fingerboard is cantilevered from the mast.

6. The apparatus of claim 1, wherein the fingerboard comprises a left side and a right side, the right and left sides being separated by the longitudinally extending passageway.

7. The apparatus of claim 1, further comprising a racker carriage track structure extending in a lateral direction, the racker device laterally moveable along the track, wherein the plurality of parallel extending fingers define openings facing the racker carriage structure.

8. The apparatus of claim 1, further comprising a racker carriage track structure disposed at an elevation above the fingerboard, the racker carriage track structure extending in a lateral direction relative to the longitudinally extending passageway.

9. The apparatus of claim 8, further comprising floor track disposed on a rig floor, the floor track extending in a lateral direction relative to the longitudinally direction between the fingerboard and the well-center drilling opening.

10. The apparatus of claim 1, wherein the plurality of drilling components comprises a top drive.

11. An apparatus comprising:

a well-center drilling opening in a drilling rig floor of a mobile drilling rig;

a v-door to the drilling rig;

a mast disposed about the well-center drilling opening and supporting a plurality of drilling components of a drilling system;

a longitudinally extending passageway between the well-center drilling opening and the v-door sized to receive and pass tubulars introduced to the drilling rig through the v-door; and a cantilevered fingerboard supported by and extending from the mast, the fingerboard comprising a first portion disposed adjacent a first side of the longitudinally extending passageway and a second portion disposed adjacent a second side of the longitudinally extending passageway, each of the first and the second portions having a plurality of parallel longitudinally extending fingers having openings between ends thereof and being arranged to receive tubulars therebetween, the plurality of fingers extending in the same direction as a line between the well-center drilling opening and the v-door; and a racker device moveable in a lateral direction relative to the direction of the line between the well-center drilling opening and the v-door.

12. The apparatus of claim 11, comprising a track laterally extending between the well-center drilling opening and a number of the openings in the fingerboard, the racker device being laterally moveable along the track.

13. The apparatus of claim 11, wherein the racker device comprises tubular interfacing elements arranged to selectively extend and pick-up one or more stands of tubulars disposed within the fingerboard.

14. The apparatus of claim 13, wherein the fingerboard is positioned relative to the well-center drilling opening so that the racker device rotates 180 degrees after picking-up a stand within the fingerboard to present the stand to the well-center drilling opening.

15. A method comprising:

removing, with a racker device, a tubular stand from a fingerboard supported at least in part by a drilling rig mast and arranged with fingers that extend in a longitudinal direction and have openings therebetween ends thereof defining a front portion of the fingerboard, the fingerboard having two portions separated by a passageway disposed between a v-door and well-center;

when the stand is clear of the fingerboard fingers, moving the racker device and the stand in a lateral direction along the front portion of the fingerboard;

rotating the racker device and the stand at least 150 degrees so that the stand faces the well-center drilling opening of a drilling rig; and presenting the stand to the well-center drilling opening.

16. The method of claim 15, wherein rotating the racker device and the stand at least 150 degrees includes rotating the racker device and the stand 180 degrees.

17. The method of claim 15, comprising grasping the stand with extendable arms of the racker device, and retracting the arms with the stand to remove the stand from the fingerboard.

18. The method of claim 15, wherein presenting the stand to the well-center drilling opening comprises extending arms of the racker device carrying the stand.

19. The method of claim 15, wherein moving racker device and the stand in a lateral direction along the front portion of the fingerboard comprises moving the racker device along a laterally extending track disposed between the well-center drilling opening and the front portion of the fingerboard.

* * * * *